US005938414A

United States Patent [19]

Kayahara et al.

[11] Patent Number: 5,938,414

[45] Date of Patent: Aug. 17, 1999

[54] LIQUID FEEDING APPARATUS HAVING A CASSETTE ACCOMMODATING AN ELASTIC TUBE

[75] Inventors: Toshihiro Kayahara; Kazuhiro Tachino; Yoshitami Tsubota; Sadatoshi Takechi; Yuuji Ukena; Satoshi Wakasa; Kimihiro Takechi; Hideo Furukawa, all of Matsuyama, Japan

[73] Assignees: Miura Co., Ltd.; Miura Institute of Research & Development Co., Ltd., both of Ehime-ken, Japan

[21] Appl. No.: 08/826,427

[22] Filed: Mar. 27, 1997

[30] Foreign Application Priority Data

Mar. 27, 1996 [JP] Japan ..... 8-099144

[51] Int. Cl.[6] ..... F04B 43/08

[52] U.S. Cl. ..... 417/476; 222/185.1

[58] Field of Search ..... 417/476, 477.1, 417/477.2, 477.3, 477.9; 604/153; 222/185.1, 333

[56] References Cited

U.S. PATENT DOCUMENTS 3,565,286 2/1971 Latham et al. ..... 417/477.1
3,723,030 3/1973 Gelfand .
3,881,641 5/1975 Pliml, Jr. et al. ..... 417/476
3,927,955 12/1975 Spinosa et al. .
4,025,241 5/1977 Clemens .
4,187,057 2/1980 Xanthopoulos .
4,256,437 3/1981 Brown .
4,537,561 8/1985 Xanthopoulos .
4,673,334 6/1987 Allington et al. .
4,886,431 12/1989 Soderquist et al. .
5,082,429 1/1992 Soderquist et al. .
5,105,992 4/1992 Fender et al. ..... 222/185.1
5,213,483 5/1993 Flaherty et al. .
5,257,917 11/1993 Minarik et al. .

*Primary Examiner*—Charles G. Freay

[57] ABSTRACT

A liquid feeding apparatus quantitatively feeds a liquid by pressing and clogging an elastic tube between a press roller and an arc-shaped guide portion through rotational motion of the press roller. The liquid feeding apparatus includes a main unit in which the press roller is provided, and a liquid cassette which accommodates a liquid cartridge. One end of the elastic tube is connected to a reservoir for the liquid to be fed, and the other end is connected to a check valve. The liquid cassette is removably fitted to the liquid feeding apparatus so that the elastic tube is subject to pressing action of the press roller.

5 Claims, 4 Drawing Sheets

LIQUID FEEDING APPARATUS HAVING A CASSETTE ACCOMMODATING AN ELASTIC TUBE

BACKGROUND OF THE INVENTION

1. Field of the Invention

The present invention relates to a quantitative feeding apparatus for various kinds of liquid reagents, which may be used for measuring a dissolved oxygen concentration of water, water hardness, a water pH value, and the like, as well as a quantitative feeding apparatus or quantitative injection apparatus for various kinds of chemicals in the medical field. More specifically, the invention relates to a liquid feeding apparatus of a cassette system which allows liquid cassettes to be freely fitted to and removed from the apparatus.

2. Description of the Prior Art

Conventionally, in various types of water examinations, roller pumping or tube pumping devices have been widely used as quantitative feeding devices for various kinds of liquid reagents. In the medical field, pumping devices have also been used as quantitative feeding or quantitative injection devices for various kinds of chemicals. With regard to these pumping devices, various techniques in which an elastic tube is provided in a removable cassette have been proposed, and are disclosed, for example, in U.S. Pat. Nos. 4,537,561 and 4,886,431.

In these prior-art examples, in either case, only the elastic tube is provided in a cassette so as to be freely fittable and removable. During quantitative feeding or quantitative injection, while the elastic tube, disposed along an arc-shaped guide portion serving as a tube receiver, is pressed and pinched by a multiplicity of press rollers, the press rollers are rotationally moved on circular tracks so as to sequentially move the pressed, clogged points of the elastic tube along the rotational direction of the drive shaft. In this way, a reagent or chemicals or the like within the tube (i.e., a liquid) is sucked and fed. In this arrangement, so that the liquid within the elastic tube is measured and fed by two adjacent press rollers, at least one press roller is in contact with the arc-shaped guide portion while clogging the elastic tube. As a result, at least one press roller is normally kept in contact with the arc-shaped guide portion while clogging the elastic tube, so that the elastic tube remains deformed flat during a rest of the feeding operation. Then, when the rest of feeding operation is prolonged, the restoring power of the elastic tube is weakened for resuming the feeding operation. Moreover, the elastic tube yields fatigue deterioration such that an accurate sucking and feeding operation cannot be maintained over a long period.

Also in the aforementioned prior-art examples, since only the elastic tube is provided in a removable cassette, only one kind of liquid can be fed in actual use. As a result, in order to feed other kinds of liquids, it would be necessary to reattach or reconnect one end of the elastic tube to reservoirs (liquid tanks) for other kinds of liquids, or to replace the liquid within the liquid reservoir, where it also becomes necessary to clean the elastic tube for feeding other kinds of liquids. Because of these factors, the foregoing prior-art arrangements exhibit considerably poor versatility, such that general versatility would require very complex operation. In particular, reagents or chemicals in these cases would involve deterioration problems in that contact with air may cause them to change or deteriorate in properties and effects. Further, when replacing liquid, care must be taken to avoid the invasion of air bubbles.

Furthermore, in various types of water examinations and in the medical field, there are some cases where two or more kinds of liquids are mixed and fed. In such a case, with the above prior-art examples, there is a need to premix several kinds of liquids and store the mixture in the premixed state. As a result, retaining the effects of such mixed liquids for a long period becomes a serious issue.

SUMMARY OF THE INVENTION

Therefore, in view of these and other problems, a first object of the present invention is to provide a liquid feeding apparatus which is designed for prolonging life of the elastic tube by preventing its fatigue deterioration, thereby ensuring an accurate quantitative feeding operation over a long period. A second object of the invention is to realize a liquid feeding apparatus which exhibits enhanced general versatility for such a type of apparatus, as well as in general versatility with simple operations, and which prevents the occurrence of problematic deteriorations in reagents or chemicals. Furthermore, a third object of the invention is to prevent the occurrence of any problems in storage of mixed liquids even when multiple kinds of reagents or chemicals are applied in a mixed state.

The present invention having been accomplished to solve the foregoing problems, in a first aspect of the invention, there is provided a liquid feeding apparatus for quantitatively feeding a liquid by pressing and clogging an elastic tube between a press roller and an arc-shaped guide portion through rotational motion of the press roller, the liquid feeding apparatus comprising a main unit in which the press roller is provided, and a liquid cassette which has accommodated therein a liquid cartridge in which the elastic tube has one end connected to a reservoir for the liquid to be fed and the other end connected to a check valve, wherein the liquid cassette is removably fitted to the liquid feeding apparatus so that the elastic tube is subject to pressing action of the press roller. In a second aspect of the invention, the liquid feeding apparatus is characterized in that the press roller is provided as one press roller, and that the rotational motion of the press roller causes the pressing action of the press roller against the elastic tube to alternate active and inactive modes. In a third aspect of the invention, the liquid feeding apparatus is characterized in that a plurality of the press rollers are provided to the main unit so as to be formed into a plurality of arrays in parallel, and that a plurality of the liquid cassettes, the number of which corresponds to the number of arrays of the press rollers, are removably fitted to the liquid feeding apparatus. In a fourth aspect of the invention, the liquid feeding is characterized in that the liquid cassette is provided by a cassette casing comprising the arc-shaped guide portion which cooperates with the press roller, a window portion through which the press roller passes in and out during the rotational motion of the press roller, and an accommodating section for accommodating therein the reservoir for the liquid to be fed, and that the liquid cartridge is accommodated in the cassette casing. In a fifth aspect of the invention, the liquid feeding apparatus is characterized in that the cassette casing comprises a first casing member having the arc-shaped guide portion formed therein, and a second casing member having the window portion formed therein, and that the liquid cartridge is pinched by and accommodated in the two casing members.

DETAILED DESCRIPTION OF THE PREFERRED EMBODIMENTS

Figure 1:
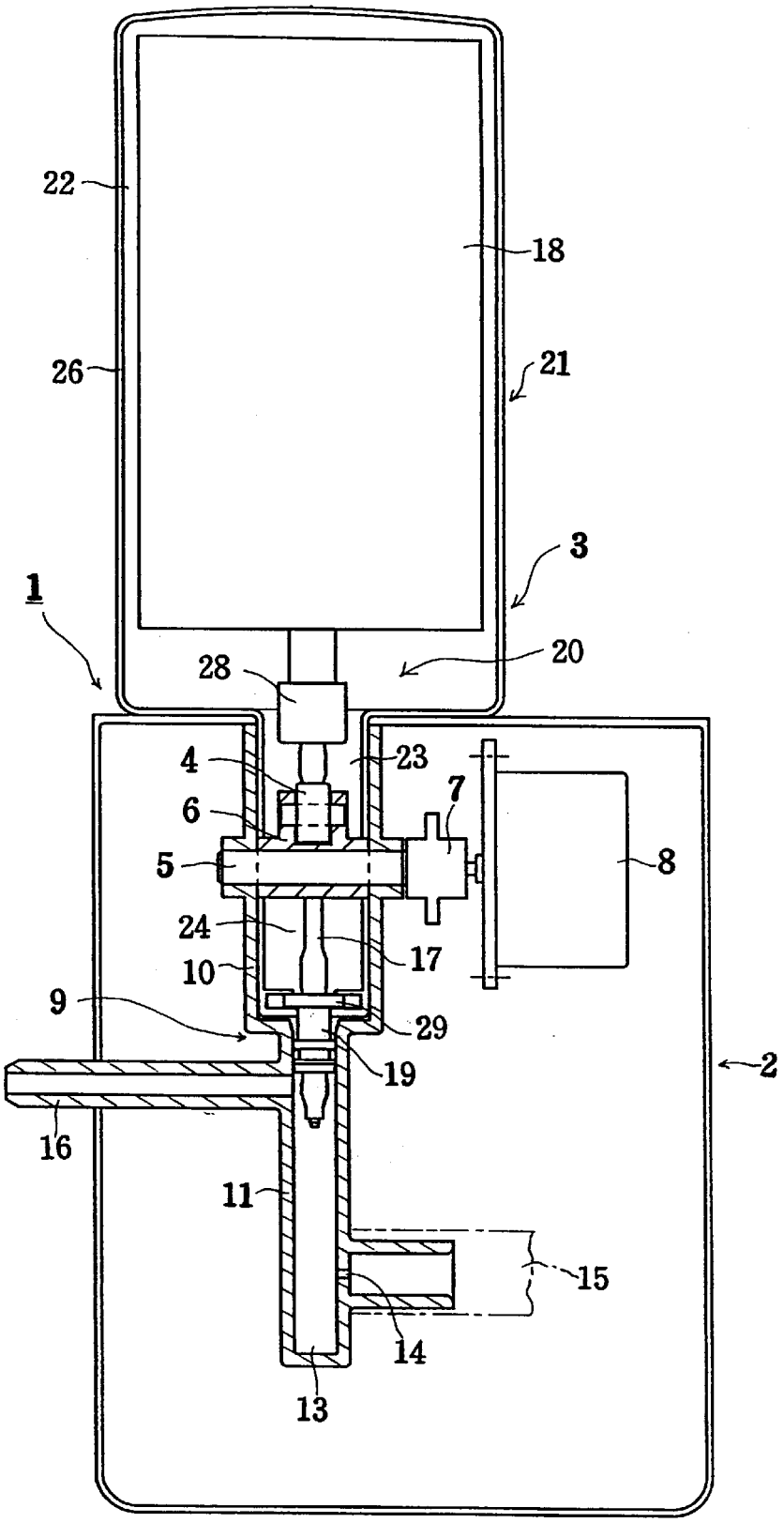
FIG. 1 is an explanatory view in cross section, as seen from the front, schematically showing the state in which the liquid feeding apparatus according to the present invention is fitted to the main unit.

Referring now to embodiments of the present invention, the invention is embodied by a liquid feeding apparatus which quantitatively feeds liquid by pressing and clogging an elastic tube between a press roller and an arc-shaped guide portion through rotational motion of the press roller. This invention is characterized in that a main unit is provided with a press roller, where a liquid cassette containing the liquid to be fed is removably fitted to the main unit. This liquid cassette is implemented as one having a liquid cartridge of integral construction accommodated therein, the liquid cartridge being constructed so that a reservoir for the liquid to be fed is connected to one end of the elastic tube, while a check valve is connected to the other end. That is, the liquid cartridge, having the reservoir and the elastic tube integrated together, is designed for the retention of effects of the liquid to be fed, in combination with the function of the check valve connected to the other end of the elastic tube. Also, lack of rigidity due to the provision of the elastic tube is solved by accommodating the liquid cartridge in the cassette, so that a positive fitting/removal to and from the main unit can be ensured by this liquid cassette. The liquid cassette is fitted in such a way that the elastic tube will undergo pressing action through the rotational motion of the press roller. Therefore, the liquid cassette is applied to the feeding apparatus reliably with a simple fitting/removal operation while maintaining the expected effects of the liquid to be fed. Furthermore, since the liquid cassette has the reservoir and the elastic tube provided in integral construction, the liquid will neither contact air, as a matter of course, nor allow invasion of air bubbles.

This invention is also characterized in that the press roller that exerts the pressing action against the elastic tube is provided as one press roller. This press roller is implemented as one which is rotatably mounted at an end portion of the drive arm fixed to the rotational drive shaft provided to the main unit. Using this single press roller, the rotational motion of the press roller along with the rotation of the rotational drive shaft causes the pressing action against the elastic tube to alternate the active and inactive modes iteratively. That is, the elastic tube is freed from the normal pressing by the press roller. As a result, the elastic tube will neither weaken in its restoring power, nor yield to fatigue deterioration. Also, the liquid cassette can be fitted and removed during the inactive mode of the press roller, so that the liquid cassette can be fitted and removed simply and reliably. Moreover, even when a need arises to feed some other kind of liquid during the feeding operation of a first kind of liquid, this can be achieved by replacing the liquid cassette with the press roller located in the inactive-mode position.

This invention is further characterized by allowing an arrangement in which a plurality of press rollers are arranged in parallel with proper intervals provided in the axial direction of the rotational drive shaft, where liquid cassettes are removably fitted in correspondence to the number of press rollers. By providing a plurality of sets of feeding points, it is possible to feed multiple kinds of liquids in mixed state. That is, with an arrangement that required liquids to be fed are prepared each as a single cassette dedicated to its corresponding kind of liquid, the only thing necessary to feed multiple kinds of liquids is to fit the liquid cassettes corresponding to the liquids to be mixed. In this case, feeding liquids with a changed mixing ratio can be achieved simply by preparing liquid cassettes having different elastic tube diameters. Therefore, it is no longer necessary to premix a plurality of kinds of liquids, or to take precautions to retain the effects of the liquids during storage in mixed state.

In this invention, preferably, the liquid cassette is implemented by providing a cassette casing separately, and the liquid cartridge is accommodated and disposed in this cassette casing. This cassette casing comprises an arc-shaped guide portion which cooperates with the press roller, a window portion through which the press roller passes in and out during the rotational motion of the press roller, and an accommodating portion for accommodating therein the reservoir for the liquid to be fed. That is, members which cooperate with the press roller and members which aid the pressing action of the press roller are all provided in this cassette casing. Accordingly, the main unit has only to be provided with the press roller and a rotational drive mechanism for the press roller. Thus, the main unit can be simplified in construction so that the whole apparatus can be made more compact.

Further, in this invention, preferably, the cassette casing is implemented by two divisions, where the liquid cartridge is pinched by and accommodated in the two divisions. For this divisional formation, the casing is divided into a first casing member having the arc-shaped guide portion provided, and a second casing member having the window portion provided, where the liquid cartridge is pinched by these two casing members. The arrangement for this pinching is constructed so that connecting portions at both ends of the elastic tube where the reservoir and the check valve are connected, respectively, can be securely pinched. This means that the two casing members have pinching portions formed at the two connecting portions, respectively. Also, as another divisional formation of the casing, it is also preferable depending on embodiments that the second casing member is provided by a lid member. As a result, when the two casing members are joined together to make up one unit, the liquid cartridge is pinched by the two casing members, in particular, at the two connecting portions securely, so that the integral construction of the liquid cartridge is made firm.

Figure 2:
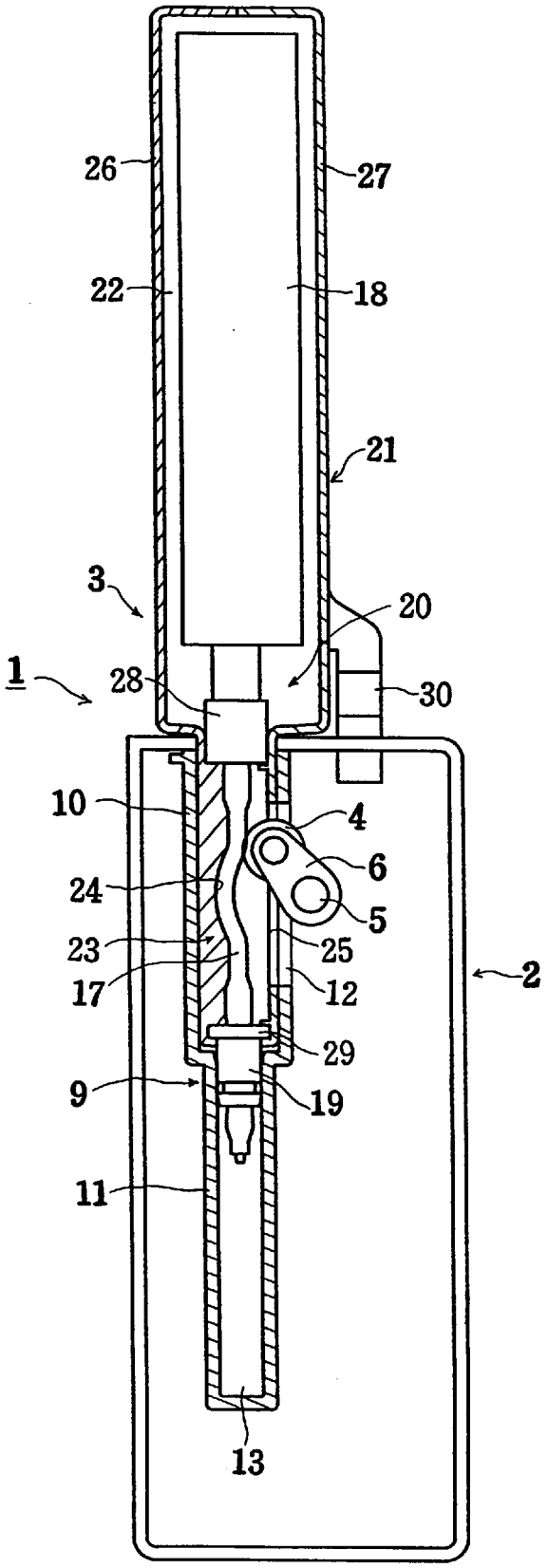
FIG. 2 is an explanatory view in cross section of FIG. 1, as seen from a side.

Hereinbelow, specific embodiments of the present invention are described in detail with reference to the accompanying drawings. The embodiments here presented are described in cases in which liquid reagent is used and in which the present invention is embodied in a hardness measuring instrument for measuring the hardness of water by quantitatively feeding the liquid reagent. FIG. 1 is an explanatory cross-sectional view as seen from the front, schematically showing the state in which the liquid feeding apparatus according to the present invention is fitted to the main unit of the hardness measuring instrument. FIG. 2 is an explanatory cross-sectional view of FIG. 1, as seen from a side. Further, FIG. 3 is an explanatory cross-sectional view, as seen from a side, schematically showing the state in which the liquid feeding apparatus according to the present invention has been removed from the main unit of the hardness measuring instrument.

Figure 3:
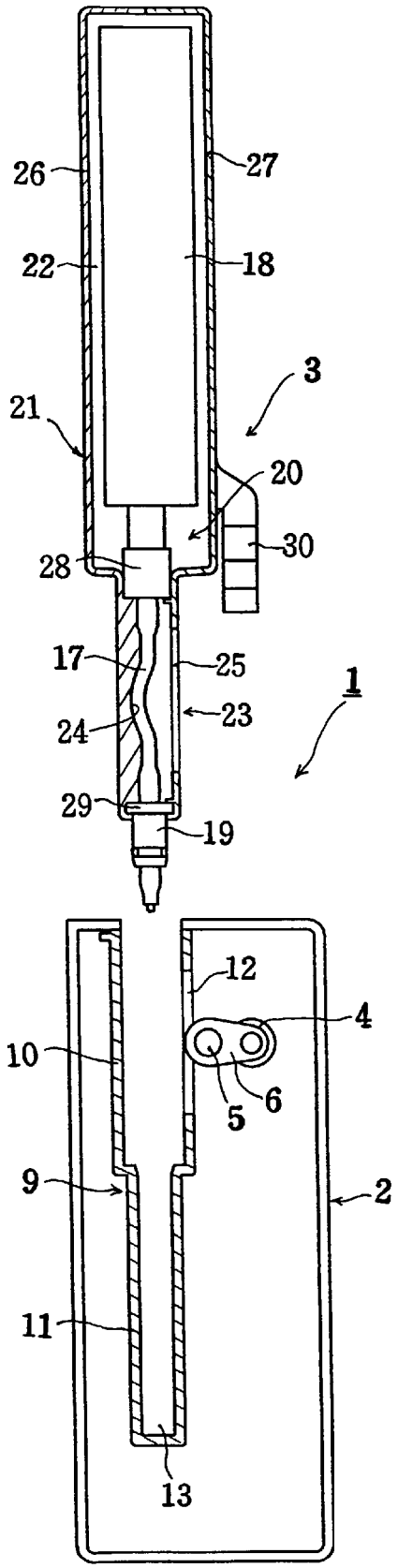
FIG. 3 is an explanatory view in cross section, as seen from a side, schematically showing the state in which the liquid feeding apparatus according to the present invention has been removed from the main unit.

Referring to FIGS. 1 to 3, the liquid feeding apparatus 1 according to the present invention basically comprises a main unit 2 of a water-hardness measuring instrument, and a liquid cassette 3 which is removably fitted to the main unit 2.

First, outlining the main unit 2 of the hardness measuring instrument, the main unit 2 is provided with a press roller 4 which presses an elastic tube 17, which will be described later, to feed the liquid reagent quantitatively or in steps of specified amounts. This press roller 4, which is rotatably mounted at an end portion of a drive arm 6 fixed to a rotational drive shaft 5, presses the elastic tube 17, while rotating by itself, along with a rotational motion of the rotational drive shaft 5. The rotational drive shaft 5 is coupled with a drive motor 8, which is provided to the main unit 2, via a coupling 7. This drive motor 8, which exerts driving operation in conjunction with the timing of measurement of the hardness measuring instrument, drives the press roller 4 into rotational motion via the rotational drive shaft 5 so that the liquid reagent is quantitatively fed in correspondence to the measuring timing.

The press roller 4 in the present invention, which is mounted one in number on the rotational drive shaft 5, alternates an active mode in which its pressing action for the elastic tube 17 is exerted and an inactive mode in which the pressing action is not exerted, through the rotational motion of the rotational drive shaft 5 in correspondence to the measuring timing of the dive motor 8.

In the main unit 2, a rectangular-cylindrical measuring cell 9 for measuring the hardness of a specimen liquid to be examined is provided, the measuring cell 9 comprising a liquid feeding section 10 which accommodates and fits lower part of the liquid cassette 3 and which serves for quantitatively feeding the liquid reagent by the press roller 4, and a measuring section 11 which communicates with the liquid feeding section 10. The liquid feeding section 10 has an opening 12 which permits the press roller 4 to rotate in the active mode. Also, the measuring section 11 is formed at its bottom into an accommodating section 13 for the specimen liquid, where a magnet type proper stirrer (not shown) is placed in the specimen-liquid accommodating section 13. In lower part of the measuring section 11, an inlet port 14 is provided for introducing the specimen liquid into the specimen-liquid accommodating section 13, where the inlet port 14 is connected to a specimen-liquid supply line 15. Further, in upper part of the measuring section 11, a discharge pipe 16 is provided for discharging the specimen liquid that has been completely subjected to the measurement at the specimen-liquid accommodating section 13, together with cleaning waste liquid.

The measurement of hardness with the above arrangement is briefly explained below. Hardness measurement generally determines the hardness of the specimen liquid by detecting variations in color due to injection of a liquid reagent into the specimen liquid. More specifically, the specimen liquid is introduced into the specimen-liquid accommodating section 13, a specified amount of the liquid reagent is injected into the specimen liquid, the specimen liquid and the liquid reagent are stirred and mixed sufficiently, and the color of the specimen liquid that has changed with the stirring and mixing is detected, by which the hardness of the specimen liquid is determined according to the detected color. Therefore, the measuring section 11 is made of a transparent member so that the color of the specimen liquid within the specimen-liquid accommodating section 13 can be detected from outside. Outside the specimen-liquid accommodating section 13, is disposed a colorimetric detector (not shown) comprising a light-emitting device and a light-receiving device and the like for detecting the color of the inside of the specimen-liquid accommodating section 13. In addition, although not described in detail, the basic operation of the hardness measurement in this embodiment is an operation of iterating the cycle comprising steps of cleaning prior to measurement inside the measuring section 11, introduction of specimen liquid, injection of liquid reagent, stirring and mixing of two liquids, color detection, cleaning after measurement, and discharge of cleaning waste liquid.

Now referring to the liquid cassette 3 that is removably fitted to the main unit 2, this liquid cassette 3 has a liquid cartridge 20 accommodated therein, where the elastic tube 17 formed from silicone rubber or the like, a reservoir 18 in which a liquid to be fed such as a liquid reagent is contained, and a check valve 19 for preventing air from flowing back into the elastic tube 17 during the inactive mode of the press roller 4 are integrated together in the liquid cartridge 20. This liquid cartridge 20 is constructed so that the reservoir 18 is connected to one end of the elastic tube 17, while the check valve 19 is connected to the other end. By virtue of this integral construction, the liquid reagent will never make contact with air, of course, while such problems as invasion of air bubbles will not occur. Furthermore, in combination with the function of the check valve 19, the effects of the liquid reagent are retained.

Next, the liquid cassette 3 for accommodating the liquid cartridge 2 is explained in more detail. The liquid cassette 3 is provided by a cassette casing 21 molded from synthetic resin or the like. In this cassette casing 21, as apparent from FIG. 3, an accommodating section 22 for accommodating the reservoir 18 of the liquid cartridge 20 is formed in upper part, while a feeding section 23 which is dimensioned so as to closely fit into the liquid feeding section 10 of the measuring cell 9 is formed in lower part. In this feeding section 23, are formed an arc-shaped guide portion 24 which cooperates with the press roller 4, and a window portion 25 through which the press roller 4 passes into and out of the feeding section 23 during the rotation of the press roller 4.

The cassette casing 21 is divisionally formed into a first casing member 26 and a second casing member 27, where the liquid cartridge 20 is accommodated by joining the two casing members 26, 27 together. More specifically, the arc-shaped guide portion 24 is formed in lower part of the first casing member 26, while the window portion 25 is formed in lower part of the second casing member 27. Further, the accommodating section 22 will be formed in upper part of the two casing members 26, 27 by joining the two casing members together. In order to make up the liquid cassette 3 with the liquid cartridge 20 accommodated into the two casing members 26, 27, a connecting portion 28 between the elastic tube 17 and the reservoir 18 as well as a mouth ring portion 29 that connects the elastic tube 17 and the check valve 19 with each other are joined together as they are pinched by the two casing members 26, 27. This arrangement allows the connection of the elastic tube 17 with the reservoir 18 and the check valve 19 to be securely attained, so that the liquid reagent can be prevented from leaking through the two connecting portions of the elastic tube 17, and that the occurrence of air inflow through the two connecting portions can be prevented securely. Furthermore, the elastic tube 17 can also be effectively prevented from separating off, for example, by de-coupling at the two connecting portions.

As described above, the liquid cassette 3 is formed in an integral construction with the liquid cartridge 20 accommodated in the two casing members 26, 27. Now the fitting of the liquid cassette 3 to the main unit 2 is explained. First, as shown in FIG. 3, the press roller 4 is brought into the inactive-mode position, the feeding section 23 in the lower part of the liquid cassette 3 is inserted into the liquid feeding section 10 of the measuring cell 9, and the feeding section 23 is fitted into the liquid feeding section 10. With the feeding section 23 fitted, the window portion 25 of the feeding section 23 is coincident with the opening 12 of the liquid feeding section 10, while the elastic tube 17 is brought to a position where the elastic tube 17 undergoes the pressing action of the press roller 4, and further the check valve 19 enters into upper part of the measuring section 11 of the measuring cell 9. In this fitted state, the press roller 4 is enabled to exert the active-mode action that the press roller 4 cooperates with the arc-shaped guide portion 24 to press and clog the elastic tube 17. Accordingly, the press roller 4 is rotated by being driven at the measuring timing of the drive motor 8, where the liquid reagent within the elastic tube 17 is pressurized and fed downstream along with the rotational motion of the press roller 4, so that the liquid reagent is fed quantitatively via the check valve 19. The liquid reagent fed from the check valve 19 drips and flows into the specimen-liquid accommodating section 13. An engaging hook 30, which is provided to the second casing member 27 in order to retain the fitted state, is fitted to an engaging hole (not shown) formed in the top surface of the main unit 2.

When the liquid cassette 3 is removed from the main unit 2, the press roller 4 is brought to the inactive-mode position, the engaging hook 30 is disengaged from the engaging hole, and the feeding section 23 is withdrawn from the liquid feeding section 10, as in the fitting process. That is, the fitting and removal of the liquid cassette 3 to and from the main unit 2 in this invention can be accomplished only by engaging and disengaging the engaging hook 30 provided to the second casing member 27.

Figure 4:
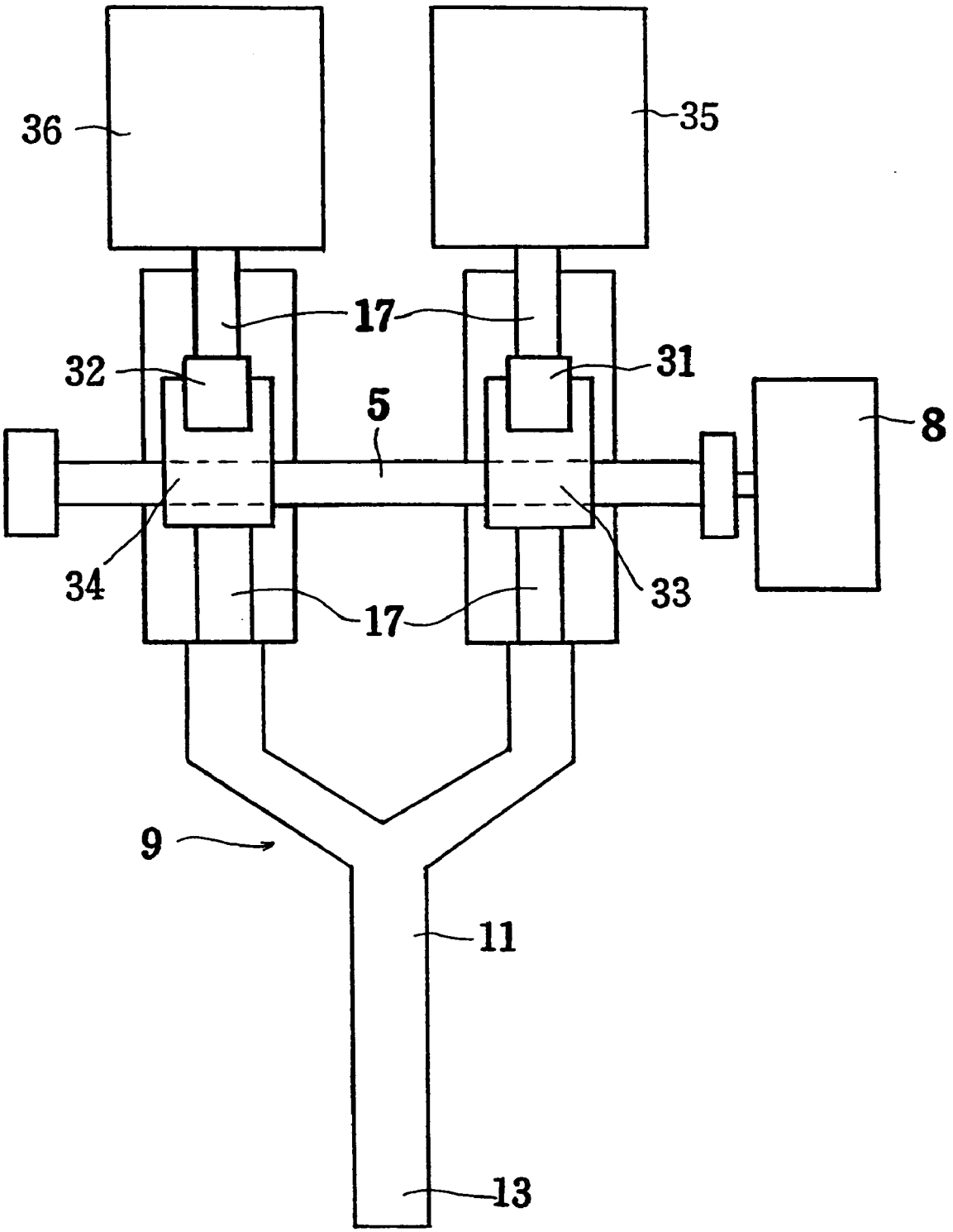
FIG. 4 is a schematic explanatory view showing a second embodiment of the present invention.

Next, a second embodiment of the present invention is described. The basic principle of the second embodiment is that a plurality of press rollers 4 are arranged in parallel at proper intervals in the axial direction of the rotational drive shaft 5, where liquid cassettes 3 corresponding to the number of the press rollers 4 are removably fitted. FIG. 4 is a schematic explanatory view showing a case in which two press rollers 4 are arranged in parallel, as a specific example. It is noted that, in FIG. 4, like numerals designate like component members used in FIGS. 1 to 3, and their detailed description is omitted.

Referring to FIG. 4, on the rotational drive shaft 5 that is driven by the drive motor 8, a first press roller 31 and a second press roller 32 are arranged in parallel with a proper interval in the axial direction. These two press rollers 31, 32 are rotatably mounted at end portions of a first drive arm 33 and a second drive arm 34, respectively, which are fixed to the rotational drive shaft 5. Further, correspondingly to these press rollers 31, 32, a first liquid cassette 35 and a second liquid cassette 36 will be removably fitted. That is, this embodiment is constituted as a liquid feeding apparatus in which two sets of quantitative feeder arrangements are incorporated. Accordingly, it is enabled to quantitatively feed liquid reagents for each set of feeding arrangements, independently of each other, along with the rotational motion of the rotational drive shaft 5.

In this second embodiment, a shown in FIG. 4, provided that the measuring cell 9 is of a merging arrangement, two kinds of liquid reagents can be fed, in a mixed state, to the specimen-liquid container section 13 of the measuring cell 9. This can be implemented by preparing two kinds of required liquid reagents each as a single cassette dedicated to its corresponding kind of liquid reagent, and by fitting the two liquid cassettes for the liquid reagents to be mixed, independently. In this case, a need of feeding the liquid reagents with the mixing ratio changed can be satisfied simply by preparing the two liquid cassettes 35, 36 so that the elastic tube 17 of either one of the liquid cassettes has a diameter different from that of the elastic tube 17 of the other liquid cassette. Therefore, it is no longer necessary to premix two kinds of liquid reagents, nor is it necessary to take steps to retain the effects of the liquid reagents during the storage in a mixed state.

As a modification of the second embodiment, when two items of examination on the specimen liquid are involved, for example when the hardness and pH value of the specimen liquid are examined, an arrangement that measuring sections 11 are provided independently of each other without merging the measuring section 11 of the measuring cell 9 as shown in FIG. 4 allows the examination of the two items simultaneously at one-time measuring timing of the drive motor 8.

Further, this invention can be implemented also as embodiments other than the second embodiment as shown in FIG. 4 and its modifications. As an example, it is preferable, depending on embodiments, that three or more press rollers 4 are placed in parallel with proper intervals in the axial direction of the rotational drive shaft 5, where the liquid cassettes 3 are removably fitted in correspondence to those press rollers 4. In this case, depending on whether the measuring sections 11 of the measuring cell 9 are merged or not, it becomes possible to feed multiple kinds of liquid reagents in a mixed state, and to carry out multiple items of examination simultaneously.

As shown above, according to the present invention, since the liquid cassette has accommodated therein a liquid cartridge in which the elastic tube has one end connected to the reservoir and the other end connected to the check valve, the liquid in the reservoir will never make contact with air and, as a matter of course, neither will air bubbles invade the liquid. Therefore, the liquid cassette can be applied to the liquid feeding apparatus reliably by a simple fitting/removing operation while retaining the expected effects of the liquid to be fed. Also, since the press roller that performs the pressing action against the elastic tube alternates the active and inactive modes of pressing action so that the elastic tube will not be normally pressed, the elastic tube will neither weaken in its restoring power nor yield fatigue deterioration. Furthermore, since the liquid cassette will be fitted and removed during the inactive mode of the press roller, the liquid cassette can be fitted and removed simply and securely.

Further, according to the present invention, it is unnecessary to premix a plurality of kinds of liquid reagents, completely eliminating the need to take steps to retain the effects of the liquid reagents during the storage in a mixed state. Also, since the members that cooperate with the press roller as well as the members that aid the pressing action of the press roller are all provided within the liquid cassette, it is only required to provide, in the main unit, no more than the press roller and a rotational drive mechanism for this press roller, so that the main unit can be simplified in construction, and that the whole apparatus can be made more compact. Furthermore, since the liquid cartridge of integral construction is accommodated in the liquid cassette as the liquid cartridge is pinched and held at its connecting portions, the liquid cartridge can be provided in a firmer integral construction, so that liquid leakage and air-bubble invasion can be prevented securely, while the elastic tube can be securely blocked from separating. Thus, there can be realized a liquid feeding apparatus which exhibits significant advantages over other types of liquid feeding devices.

What is claimed is:

1. A liquid feeding apparatus for quantitatively feeding a liquid by pressing and clogging an elastic tube between a press member and a guide portion through motion of said press member, said liquid feeding apparatus comprising:

a main unit in which said press member is provided; and a liquid cassette which has accommodated therein said elastic tube and a liquid cartridge, in which one end of said elastic tube is connected to a liquid reservoir provided in said liquid cartridge and the other end of said elastic tube is connected to a check valve, wherein said liquid cassette is removably fitted to said main unit so that said elastic tube is subject to a pressing action of said press member through an opening of said liquid cassette.

2. The liquid feeding apparatus according to claim 1, wherein said press member is a press roller, and wherein a rotational motion of said press roller causes the pressing action of said press roller against said elastic tube to alternate active and inactive modes.

3. The liquid feeding apparatus according to claim 1, wherein said liquid feeding apparatus includes a plurality of parallel arranged press members, and wherein a plurality of liquid cassettes the number of which corresponds to the number of said plurality of press members are removably fitted to said liquid feeding apparatus.

4. The liquid feeding apparatus according to claim 1, wherein said liquid cassette is provided by a cassette casing comprising:

said guide portion which cooperates with said press member, a window portion through which said press member passes in and out during the motion of said press member, and an accommodating section for accommodating therein said liquid reservoir for the liquid to be fed, and wherein said liquid cartridge is accommodated in said cassette casing.

5. The liquid feeding apparatus according to claim 4, wherein said cassette casing comprises:

a first casing member having said guide portion formed therein, and a second casing member having said window portion formed therein, and wherein said liquid cartridge is pinched by and accommodated in said first and second casing members.

* * * * *